US007392860B2

(12) United States Patent
Johnston

(10) Patent No.: US 7,392,860 B2
(45) Date of Patent: Jul. 1, 2008

(54) STRIPPER RUBBER ON A STEEL CORE WITH AN INTEGRAL SEALING GASKET

(76) Inventor: Vaughn R. Johnston, 240 Kelley Rd., Washington, PA (US) 15301

( * ) Notice: Subject to any disclaimer, the term of this patent is extended or adjusted under 35 U.S.C. 154(b) by 339 days.

(21) Appl. No.: 11/370,458

(22) Filed: Mar. 7, 2006

(65) Prior Publication Data

US 2007/0209841 A1 Sep. 13, 2007

(51) Int. Cl.
*E21B 19/00* (2006.01)

(52) U.S. Cl. ..... 175/195; 166/58.3; 166/81.1

(58) Field of Classification Search ..... 166/88.4, 166/383; 175/84
See application file for complete search history.

(56) References Cited

U.S. PATENT DOCUMENTS 3,868,832 A * 3/1975 Biffle ..... 464/163
5,062,479 A * 11/1991 Bailey et al. ..... 166/84.3
6,016,880 A * 1/2000 Hall et al. ..... 175/195
6,244,359 B1 * 6/2001 Bridges et al. ..... 175/5
6,702,012 B2 * 3/2004 Bailey et al. ..... 166/84.4
7,080,685 B2 * 7/2006 Bailey et al. ..... 166/84.4

* cited by examiner

*Primary Examiner*—Frank S Tsay
(74) *Attorney, Agent, or Firm*—Clifford A. Poff

(57) ABSTRACT

An elongated stripper rubber having a converging internal passage extending to a neck portion elastically expanded to snugly receive a drill string. The elongated stripper rubber is adhered to a steel core having a truncated conical load bearing surface containing an annular gasket cavity containing a truncated conical gasket. The volume of elastic material protruding from the truncated conical load bearing surface can be compressed into the gasket cavity between the steel core and a truncated conical annulus in an outer housing.

8 Claims, 3 Drawing Sheets

STRIPPER RUBBER ON A STEEL CORE WITH AN INTEGRAL SEALING GASKET

CROSS-REFERENCE TO RELATED APPLICATIONS

Not Applicable

BACKGROUND OF THE INVENTION

1. Field of the Invention

The present invention relates to providing a seal between a stationary housing and a stripper rubber constructed to snugly receive a drill string-passed in a well casing for a well bore, and, more particularly, to the provision of a sealing gasket constructed and arranged for compressing an elastic seal material in a truncated conical cavity between such a stationary housing and steel core secured to such a stripper rubber.

2. Description of the Prior Art

Oil, water and gas wells are drilled with a drill bit attached to a hollow drill string which passes through a well casing installed in the well bore. A drilling head is usually attached to the top of the well casing where it emerges from the ground to seal the interior of the well casing from the surface and thereby permit the forced circulation of drilling fluid or gas during drilling operations. In the more commonly-used forward circulation drilling mode, the drilling fluid or gas is pumped down through the interior of the hollow drill string, out the bottom thereof, and upward through the annulus between the exterior of the drill string and the interior of the well casing. In reverse circulation, the drilling fluid or gas is pumped down the annulus between the drill string and the well casing and then upward through the hollow drill string.

The drilling head typically includes a stationary body to support a spindle that is rotated by a kelly for the rotary drilling operation. A seal often referred to as a stripper packer, is carried by the spindle to seal the periphery of the kelly or the sections of drill pipe, whichever is passing through the spindle, and thereby confine the fluid pressure in the well casing and prevent the drilling fluid, whether liquid or gas, from escaping between the rotary spindle and the drill string. The rotation of the kelly and drill string is accompanied by frequent upward and downward movement of the kelly and drill string as required for the addition of drill pipe sections. The high pressure fluid supplied to the drilling head requires that the stripper packing in the drilling head withstand continuous flexing of the rubber mass engaged with the kelly or drill string. When the drilling of a well proceeds to greater depths, and may also include the use of air as the drilling fluid, the effective sealing with long continued integrity is important to prevent unwanted release of the drilling fluid under the necessary higher pressure.

The arrangement of parts used to maintain the integrity of the sealed condition of the parts associated with the attachment of the stripper packer at the rotary spindle has been a source of problems involving the containment of drilling fluid pressure. Typically, the stripper packer includes an elongated generally cylindrical hard-rubber packer having an annular mounting collar secured to its upper end. The mounting collar, in turn, is secured onto the lower end of the rotatable spindle. Often the mounting collar is secured to the stripper packer by being molded integrally therewith. That is, the mounting collar often includes such structural expedients as a radial-projecting lip, a circumferential dovetail keyway, or a plurality of radial through openings onto or through which the stripper rubber is directly molded for a positive mechanical interlock between the mounting flange and the stripper rubber. Some such packers may have been subject to instances of tearing of the stripper rubber or breaking of the fluid seal with the mounting collar due to localized stress concentrations at the rubber to collar interface. Among the known structures are those disclosed in U.S. Pat. Nos. 4,345,769; 3,503,617; 3,400,938; and 2,170,916.

A stripper packer assembly is disclosed in U.S. Pat. No. 4,486,025 having separable mounting collar and a stripper rubber element wherein nut and bolt assemblies dispersed about a bolt circle are used to compressively clamp the stripper rubber in face sealing engagement with an extended formed sealing surface of the mounting collar. The stripper packer is used to provide a fluid pressure-tight seal and to provide for transmission of torque loads from the stripper rubber to the mounting collar.

The sealing relationship between the stripper packer and the mounting collar also includes the use of an O-ring seated in a mounting groove formed in an annular section of the mounting collar. The mounting collar must be passed into a suitably enlarged bore in the rotary spindle and in so doing the O-ring protruding from the periphery of the collar must be compressed to fit in the bore so that the operative position of the O-ring forms an elastic seal with the bore without damage to the O-ring. When the assembling operation must be accomplished at the drilling site, the working conditions are a disadvantage. The immediate area surrounding the drilling head at the drilling site presents a particularly harsh environment for carrying out the required assembly operation for the stripper packer. The ever presents of dirt and encounters with drilling slurry increase the difficult but necessary alignment of parts to form the seal in the stripper packer. These conditions are especially acute when assembling an o-ring type seal. An intended sealed relation between the parts forming the stripper packer is often discovered by the occurrence of the leakage to the site of the sealing surface only after commencing the drilling operation thus prolonging costly downtime. The art has not produced many viable alternatives to the above-described structures to provide a sealed condition between the stripper rubber and the housing of the drill head due, in part, to the difficulty of forming suitable releasable connection between a mounting collar and a stripper rubber. This has been particularly true in those cases where the frictional engagement between the stripper rubber and the drill string provides the rotary driving force for the rotary spindle in the drilling head. In such instances, the stripper rubber is under constant torque loading and this tends to accelerate wear and ultimate failure of the rubber-to-mounting collar seal.

Accordingly, it is an object of the present invention to provide a gasket face protruding from the truncated conical load bearing surface of a steel core-used also to mount a stripper rubber thereto.

It is a further object of the present invention to provide an elastic sealing gasket for compressing against a truncated conical surface disposed between a stationary housing and stripper rubber forming part of a drilling head.

SUMMARY OF THE INVENTION

According to the present invention there is provided a seal assembly for a drill string, the seal assembly including the combination of an elongated stripper rubber having a converging internal passage terminating at a neck portion for elastically expanding to snugly receive a drill string, a steel core adhered to the elongated stripper rubber remote to the neck portion, the steel core having a truncated conical load bearing surface containing an annular gasket cavity of a predetermined depth, a truncated conical gasket comprised of a sufficient volume of elastic material to present a truncated conical gasket face protruding from the truncated conical load bearing surface, and a hollow cylindrical housing with a truncated conical annulus for compressing the truncated conical gasket into the annular gasket cavity between spaced cylindrical regions receiving outer peripheries of the elongated stripper rubber and the steel core.

Preferably, the seal assembly further including a hinged clamp with a cavity receiving an external ring section of the hollow cylindrical housing to present a tapering face surface in a force transmitting relation with the tapered marginal face for compressing the truncated conical load bearing surface against the truncated conical annulus. The truncated conical gasket and the elongated stripper rubber are contiguous and bonded to the steel core. The predetermined depth of the annular gasket cavity is selected to receive a volume of the truncated conical gasket when compressed by the truncated conical annulus and the truncated conical gasket protrudes from the truncated conical load bearing surface a distance not greater than the predetermined depth of the annular gasket cavity. The elongated stripper rubber preferably includes an annular peripheral wall merging with the truncated conical gasket at a diameter that foreshortens the truncated conical gasket face.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figure 1:
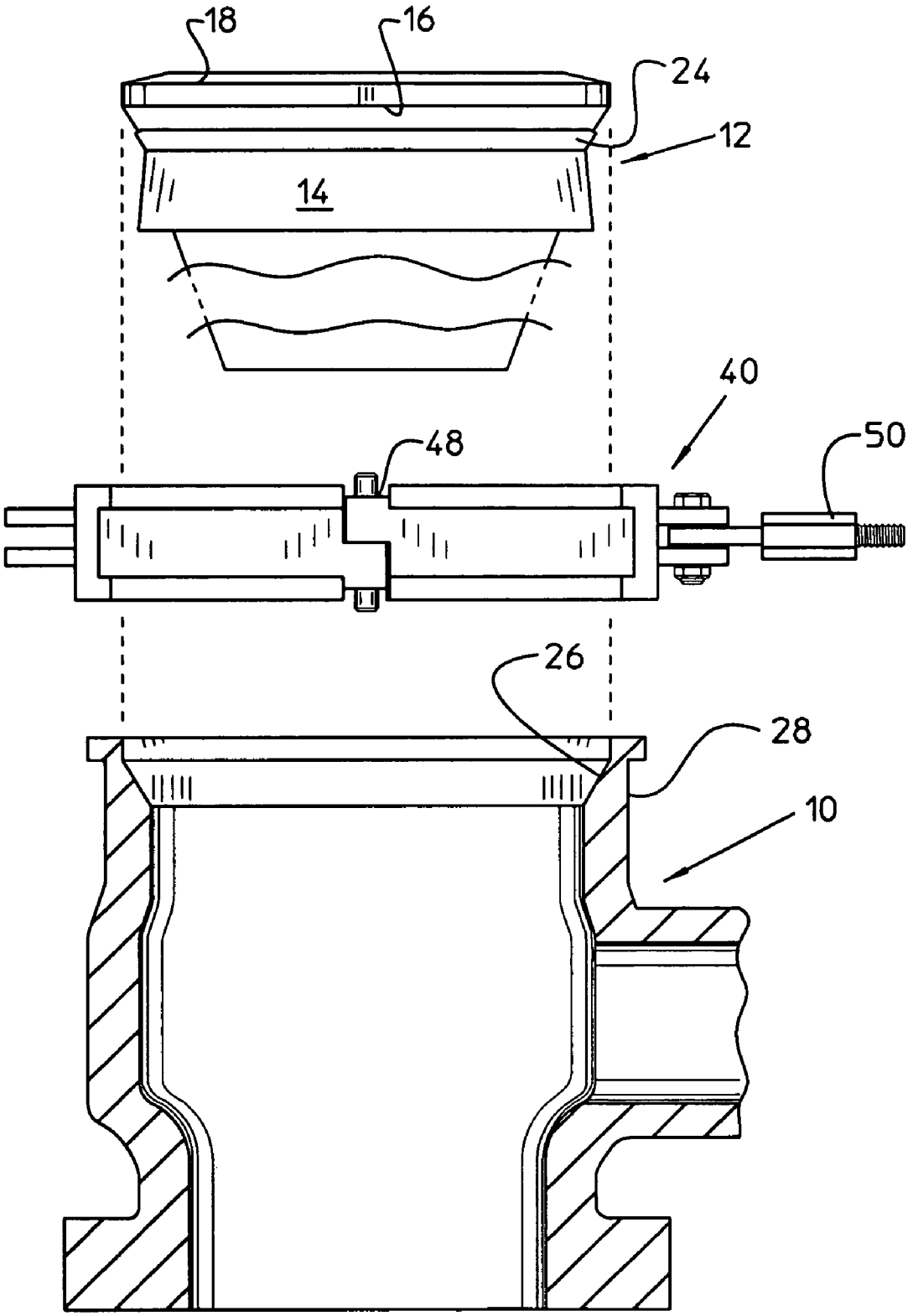
FIG. 1 is an elevation view in section of a drilling head including a stripper packer of the present invention.
Figure 2:
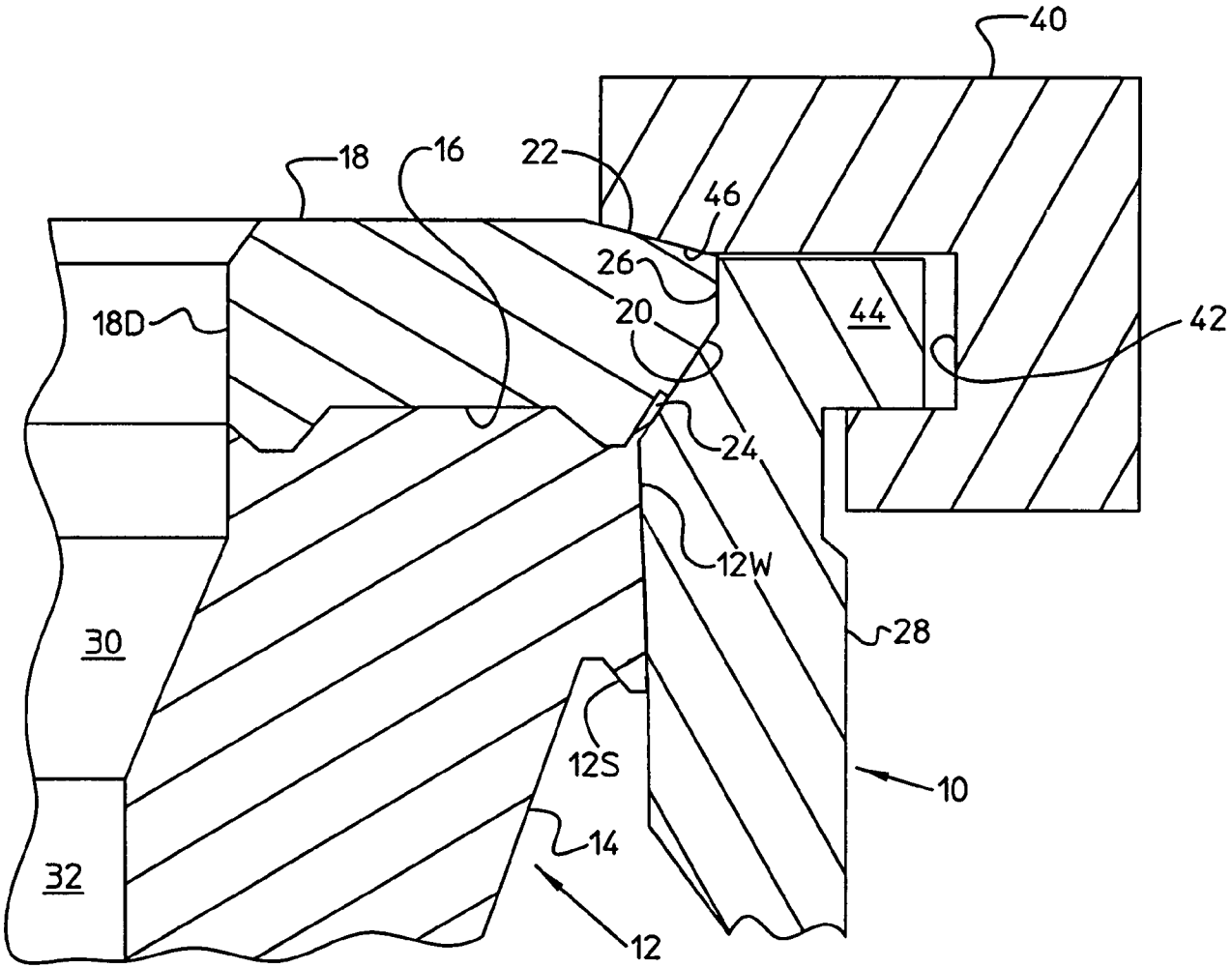
FIG. 2 is an enlarged partial sectional view taken along the upper portion of the drill head showing the sealed engagement with the stripper packer of FIG. 1.
Figure 3:
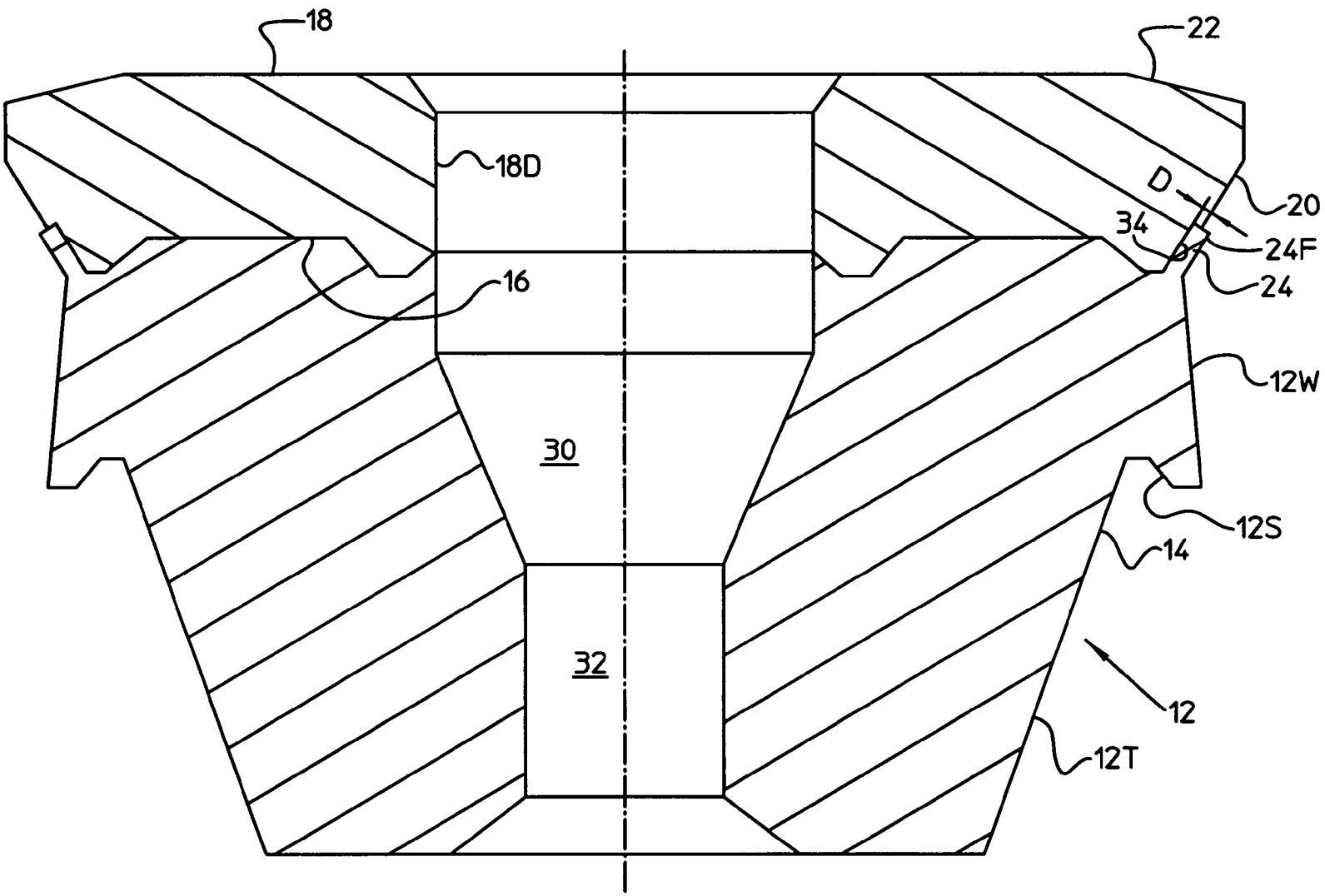
FIG. 3 is an enlarged partial sectional view similar to the illustration of FIG. 2 and illustrating the configuration of the stripper rubber, seal gasket and steel in a relaxed state.

A drilling head 10 is illustrated in FIG. 1, per se, well known in the art and employed to receive a striper rubber 12 embodying the features of the present invention. A stripper rubber takes the form of an elongated and generally cylindrical molding 14 adhered to a face surface 16 of a steel core 18. The steel core is constructed with two compression surfaces 20 and 22 each having a truncated conical configuration and disposed to form an acute angular relation at the outer periphery of the steel core as shown in FIGS. 2 and 3. The tapered face 22 extends from the outer periphery of the steel core in a direction for increased thickness of the steel core. A seal assembly is formed by the compression surface 20 carrying a compressive a gasket 24 for sealing contact with a truncated conical annulus 26 of a hollow cylindrical housing 28. The housing supports the stripper rubber in the operative position within the drill head having a converging internal passage 30 terminating at a neck portion 32 for elastically expanding to snugly receive a drill string, not shown. The neck portion 32 is remote to and defines a diameter significantly smaller than, as can be seen in FIGS. 2 and 3, the diameter of the aperture 18D in the steel core and smaller than the outer diameter of the drill pipe so that when the drill pipe is passed through the neck portion, it elastically expands to create a fluid pressure tight circumferential seal between the drill pipe and the neck portion 32 at the internal passage 30.

The steel core 18 is formed with an annular gasket cavity 34 of a predetermined depth, D, at a location intercepting the truncated conical load bearing surface 20 and continuing as a recessed and truncated conical surface of reduced diameter to intersect with the outer periphery of the face surface 16 of the steel core 18. The gasket 24 is comprised of a sufficient volume of elastic material to present a truncated conical gasket face 24F protruding from the truncated conical load bearing surface 20 of the steel core 18. The arrangement is such that the depth D of the gasket cavity and the distance the gasket protrudes from the surface 20 are such that the truncated conical annulus 26 of the hollow cylindrical housing 28 compresses the gasket into the annular gasket cavity 34 between spaced cylindrical regions receiving outer peripheries of the elongated stripper rubber and the steel core. This arrangement allows the desired sealing under compressive pressure without the occurrence of a torque force on the gasket that might tear, strip or otherwise dislodge the gasket from the cavity 34. Generally, the truncated conical gasket protrudes from the truncated conical load bearing surface a distance not greater than the predetermined depth D of the annular gasket cavity 34.

In the preferred embodiment as illustrated in FIGS. 2 and 3, the truncated conical gasket 24 is contiguous with the elongated stripper rubber 12 and both of the gasket and the rubber are bonded to the steel core incident to vulcanizing of a rubber mass in a suitable mold used to form these components.

Additionally, the outer peripheral surface of the elongated stripper rubber includes a peripheral wall 12W merging with truncated conical gasket face 24F at a diameter that foreshortens truncated conical gasket face as compared with the underlying gasket cavity. The annular peripheral wall 12W occurs in the compressed state as illustrated in FIG. 2 but in the relaxed state the peripheral wall has the form of a truncated configuration with an increasing diameter terminating at a stepped transition 12S and thence proceeds as a truncated wall section 12T with an ever decreasing diameter as illustrate in FIG. 3.

The seal assembly is placed in an operative condition as shown in FIGS. 1 and 2 by the use of a clamp 40 having a cavity 42 receiving an external ring section 44 of the hollow cylindrical housing 28 to present a tapering face surface 46 in a force transmitting relation with the tapered marginal face 22 for compressing the truncated conical load bearing surface 20 against the truncated conical annulus 26. The clamp is formed by two segments joined by a hinge 48 and secured at the free end by a nut and bolt fastener assembly 50.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

The invention claimed is:

1. A seal assembly for a drill string, said seal assembly including the combination of:

an elongated stripper rubber having a converging internal passage terminating at a neck portion for elastically expanding to snugly receive a drill string;

a steel core adhered to said elongated stripper rubber remote to said neck portion, said steel core having a truncated conical load bearing surface containing an annular gasket cavity of a predetermined depth;

a truncated conical gasket comprised of a sufficient volume of elastic material to present a truncated conical gasket face protruding from said truncated conical load bearing surface; and a hollow cylindrical housing with a truncated conical annulus for compressing said truncated conical gasket into said annular gasket cavity between spaced cylindrical regions receiving outer peripheries of said elongated stripper rubber and said steel core.

2. The seal assembly according to claim 1 further including a clamp for compressing said truncated conical load bearing surface against said truncated conical annulus.

3. The seal assembly according to claim 1 wherein said steel core includes a tapered marginal face extending from the outer periphery of said steel core in a direction for increased thickness of said steel core, and a hinged clamp having a cavity receiving an external ring section of said hollow cylindrical housing to present a tapering face surface in a force transmitting relation with said tapered marginal face for compressing said truncated conical load bearing surface against said truncated conical annulus.

4. The seal assembly according to claim 1 wherein said truncated conical gasket is contiguous with said elongated stripper rubber.

5. The seal assembly according to claim 1 wherein said truncated conical gasket and said elongated stripper rubber are bonded to said steel core.

6. The seal assembly according to claim 1 wherein said predetermined depth of the annular gasket cavity is selected to receive a volume of said truncated conical gasket when compressed by said truncated conical annulus.

7. The seal assembly according to claim 1 wherein said truncated conical gasket protrudes from said truncated conical load bearing surface a distance not greater than said predetermined depth of said annular gasket cavity.

8. The seal assembly according to claim 1 wherein said elongated stripper rubber includes an annular peripheral wall merging with said truncated conical gasket at a diameter that foreshortens said truncated conical gasket face.

* * * * *